US005211653A

United States Patent [19]

Nakajima

[11] Patent Number: 5,211,653

[45] Date of Patent: May 18, 1993

[54] PIERCING APPARATUS

[76] Inventor: Takeshi Nakajima, 46-8, Takinogawa 5-Chome, Kita-Ku, Tokyo, Japan

[21] Appl. No.: 835,398

[22] Filed: Feb. 14, 1992

[30] Foreign Application Priority Data

Feb. 19, 1991 [JP] Japan ..... 3-046014

[51] Int. Cl.[5] ..... A61B 17/00

[52] U.S. Cl. ..... 606/188

[58] Field of Search ..... 606/185, 188, 117; 227/67, 73

[56] References Cited

U.S. PATENT DOCUMENTS

| | | | |
|---|---|---|---|
| 4,068,668 | 1/1978 | Moore et al. | 606/188 |
| 4,079,740 | 3/1978 | Phalon | 606/188 |
| 4,146,032 | 3/1979 | Rubenstein et al. | 606/188 |
| 4,527,563 | 7/1985 | Reil | 606/188 |
| 4,860,747 | 8/1989 | Sciara | 606/188 |
| 4,931,060 | 6/1990 | Aué606 | 188/ |
| 5,007,918 | 4/1991 | Mann | 606/188 |

FOREIGN PATENT DOCUMENTS 59-30401 7/1984 Japan .

*Primary Examiner*—C. Fred Rosenbaum
*Assistant Examiner*—William W. Lewis
*Attorney, Agent, or Firm*—Jacobson, Price, Holman & Stern

[57] ABSTRACT

The present invention presents a piercing apparatus that pierces an earlobe with a piercing needle integrated in a cartridge, and fastens the needle by using a fastener. One of the objects of this invention is to distinguish clearly in the initial operation the position pierced that will be, the needle is actually shot through the earlobe. The piercing apparatus has a piercing needle (1) integrated in a cartridge (C) and a fastener (2) which is attached to the needle. The needle (1) and the fastener (2) are respectively mounted at the forward and backward positions of the piercing apparatus' main body (10) and can move toward and away from each other. A trigger (14) is springloaded with a spring to keep the above separated positions, and is pressed to release the shooting-out shaft (15) through a releasing means (18) in order to shoot the piercing needle (1) Then, the releasing means (18) are disposed at the forward and backward positions with respect to the anchoring member (17), on the trigger side and the anchoring member side, respectively. Torque remains small and does not engage the releasing means (18) when the position to pierce is being determined, and the torque increases due to the engagement. In this way, one can be certain that the piercing needle (1) is ready to shoot out.

3 Claims, 3 Drawing Sheets

PIERCING APPARATUS

BACKGROUND OF THE INVENTION

1. Field of the Invention

The present invention relates to an apparatus for piercing earlobes so that so-called pierced earrings can be worn.

2. Description of the Prior Art

An apparatus for piercing earlobes so that pierced earrings can be worn has already been presented, for example, in Japanese Examined Patent Publication No. 59-30401. This type of apparatus has a plunger construction from which a piercing needle can be introduced. The piercing needle is sealed in a cartridge so that a germ-free environment can be maintained until the needle is used. The cartridge is set at the pointed end portion of a plunger assembly, which consists of a supporting member and an operating portion which are coupled with each other to enable a relative sliding movement. The operating portion is pressed so that the earlobe can be pierced with the piercing needle.

In the apparatus according to the above-mentioned invention, however, the finger force of the operator of the apparatus is the same as the force necessary to pierce the earlobe with the piercing needle. Therefore, the time required by the piercing operation will vary depending on the operator. In other words, it may take long or short time to pierce an earlobe depending on a level of the piercing skill of the operator. Thus, the present inventor has invented a piercing apparatus that has a piercing needle which is shot out by the elastic force of a spring activated with an operating lever. At this moment, the apparatus is supported in one hand in order to pinch the earlobe therein.

SUMMARY OF THE INVENTION

It is an object of the present invention to provide a piercing apparatus which has been further improved based on the above-mentioned apparatus. The apparatus according to the present invention enables a piercing needle to be more precisely and more securely at the desired spot on the earlobe.

An another object of the present invention is to provide a piercing apparatus which can be operated with one hand, and which has a piercing needle to which force is applied by the constant elastic force of pressure stored in a spring. In the apparatus, it is possible to intentionally shoot out the piercing needle after assuring the pinching condition of the earlobe in the apparatus and the spot that will be pierced. Therefore, the apparatus of the present invention can be easily operated by someone with no particular skill in piercing earlobes.

These and other objects have been attained by the piercing apparatus which consists of a grip (11) at a lower position, which can be held in only one hand, a hollow main body (10) provided with a mounting portion (12) to mount a back member (4) in the above-mentioned cartridge (C) at the forward portion, a trigger (14) with a supporting member (13) forwardly extending in order to mount a front member (3) in the cartridge C, and forwardly spring-loaded in order to keep the respective members (3, 4) separate, a shooting-out shaft (15) enabling external operation,, provided movably back and forth at the backward position of the mounting portion (12) in the main body, and forwardly pressing out a piercing needle (1) in the cartridge at the pointed end when moving forward, a spring (16) with pressure stored by the operation, which moves the shooting-out shaft (15) backward, an anchoring member (17) spring-loaded in the same direction as the shooting-out shaft (15), an anchoring for the shooting-out shaft (15) at the site where the pressure stored is, a releasing means (18) which is disposed at the forward or backward with respect to the anchoring member (17), and which is provide to engage with the anchoring member (17) to release the shooting-out shaft (15) from the anchoring member (17) after the front member (3) comes close to the back member (4) by operation of the trigger (14).

The trigger (14) serves as an operating member which allows the piercing needle (1) to shoot out directly. In addition, it is possible to move the front member (3) close to the back member (4) of the piercing cartridge (C) before the piercing needle is shot out by operation of the trigger (14). Therefore, the spot on an earlobe (Y) that will be pierced can be selected with certainty. Consequently, an engagement occurs in the releasing means (18) in the vicinity of the very limit position where the front member (3) is close to the back member (4). As a result, the shooting-out shaft (15) is released from the anchoring condition so that it can shoot out the piercing needle (1).

The releasing means (18) is integrally mounted on the top of the trigger (14). The trigger (14) can move forwards and backwards in order to pull down the anchoring member (17) and release the anchoring member's (17) hold on the shooting-out shaft (15). Furthermore, the releasing means (18) consists of projections (20, 21) of the kind that the projection (20) provided on the top of the trigger (14) is disposed at the position forwardly separated from the projection (21) for engaging with the anchoring member (17). The respective projections (20, 21) are engaged with each other after the earlobe (Y) is pierced by operation of the trigger (14).

Thus, a process to move the front member (3) close to the back member 4 before shooting-out the piercing needle (1) is provided. After this process, the respective projections (20, 21) are engaged with each other so as to rapidly increase the torque (operating force) generated by pressing the trigger (14). Accordingly, it is possible to accurately ascertain when the piercing needle (1) is ready to use.

The releasing means (18) as set forth above can distinguish the initial operation to easily move the trigger (14) with a smaller force, from the shooting operation, which requires a larger force. Therefore, the releasing means (18) can serve as a safety apparatus since the piercing operation will be executed depending on the condition of the releasing means (18).

DESCRIPTION OF THE PREFERRED EMBODIMENTS

Figure 1:
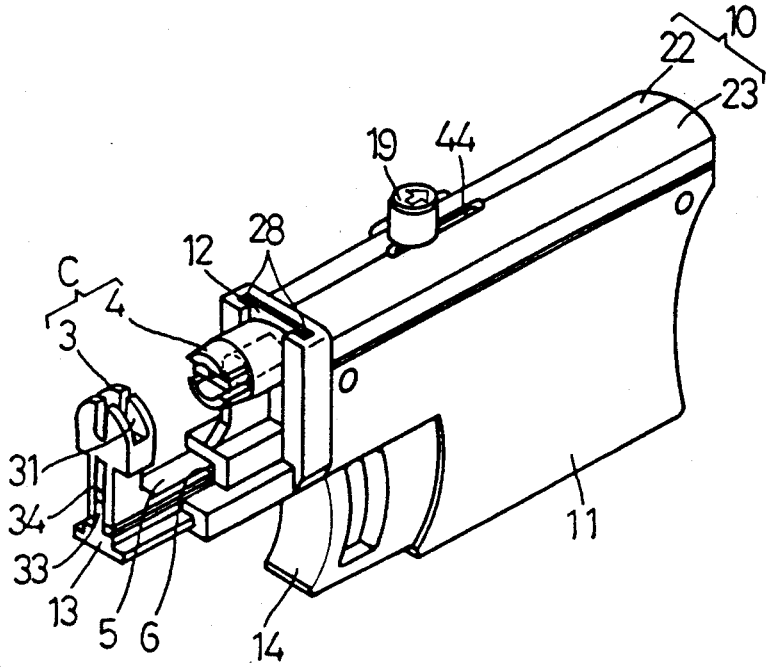
FIG. 1 is a perspective view illustrating the piercing apparatus of the present invention.

The present invention will be described with reference to drawings in the following.

The main body (10) has a hollow construction consisting of left and right parts (22, 23) which are respectively provided in flat case forms and coupled with each other. A grip (11) is provided at the lower part of the respective parts. An opening is provided at the front of th grip (11), and a trigger (14) with a finger holder extends forward from the opening and is integrated in a way that allows it to move back and forth. Numeral (24) designates a pair of guiding grooves extend forward and backward on the forward side at the intermediate portion of the respective parts of the main body, and have substantially U-shaped sections. In addition, the guiding grooves (24) are engaged with the respective sides of a supporting member (13) in order to provide support to move back and forth. The supporting member (13) extends forward from the top of the trigger (14). (25) designates a spring receiving portion with a bar-shaped form is provided behind the trigger (14). (26) designates a spring receiving portion with a bar-shaped form is provided at the position expanded from the spring-receiving portion (25) on the main body. The respective spring-receiving portions (25, 26) support the respective ends of trigger spring (27) acting on the trigger (14) to move it backward.

The supporting member (13) slides back and forth in unison with the trigger (14). A surface which serves as a cartridge mounting portion (12) is provided above the pointed-end portion of the supporting member (13). A front member (3) of the cartridge (C) is engaged with engaging portions (28) which are provided on the supporting member (13). The cartridge (C) has a piercing needle (1) integrated with a back member (4), and a fastener (2) integrated with a front member (3), respectively. The germ-free cartridge (C) is sealed in this condition, and is disposable. The front member (3) has an extending piece (5) consisting of engaging projections (29) which extend downward to engage the engaging portions (28). The extending piece (5) engages with an engaging groove (6), which is provided below the back member (4). Thus, the front member (3) and the back member (4) can move toward and away from each other. The piercing needle (1) is integrated with a holding hole (30), which is provided in the back member (4) above the shooting-out shaft (15). The fastener (2) is integrated coaxially with the groove (31) of the front member (3) and is removable upwardly. (32) designates a member serves to stop the piercing needle (1), and is fractured by a shooting-out shaft (15) which moves forward. (33) designates a projection extends from the pointed end of the supporting member (13), and is engaged with a longitudinal groove (34) of the front member (3).

The shooting-out shaft (15) is a bar-shaped member integrated in a way that allows it to back and forth at the upper portion of the main body. It has a large diameter portion (35) at the intermediate portion thereof, and has small diameter portions (36, 37) at the forward and backward positions of the large diameter portion (35). Furthermore, the shooting-out shaft (15) has an anchoring step portion (38) which allows it to be anchored to the anchoring member (17) at a lower portion on the forward side of the large diameter portion (35). Moreover, it has a back surface, which serves to receive a stored pressure spring (16). (40) designates a shaft holding portion which provide a portion corresponding to the shooting-out shaft (15) in the main body. The front end of the shaft holding portion (40) serves as a shooting-out opening (42) to shoot out the pointed end portion (41) of the shooting-out shaft (15). The rear area of the shaft holding portion (40) serves to receive the stored pressure spring (16). The operating knob (19) extends from the upper part of the shooting-out shaft (15), and extends through an elongated hole (44), which is provided at the top of the main body.

The anchoring member (17) to anchor the shooting-out shaft (15) is provided to stop the shaft in the spring-loaded condition. The anchoring member (17) has a projection (45) attached to the anchoring step portion (38), and is pivotally supported on the main body in such a manner that the projection (45) can enter and leave the shaft-holding portion (40) through a hole (46) which is provided in the wall of the shaft-holding portion (40). Furthermore, the anchoring member (17) is disposed above the trigger (14) and below the shooting-out shaft (15), and includes a spring (48) which allows it to be engaged with the shooting-out shaft (15). The spring (48) is disposed between the spring-receiving portion (47) provided on the sliding groove which also serves as the guiding groove (24) for the trigger (14), and the bottom of the anchoring member (17). Furthermore, the anchoring member (17) can rotate because it is supported on a pivot (49) mounted at the front thereof.

A releasing means (18) is provided to move with the trigger (14) and release the shooting-out shaft (15) between the trigger (14) and the anchoring member (17). The releasing means (18) includes an engaging portion (50) which has a claw-like portion extending backwards on the top of the trigger (14), and an engaging rod portion (51) which has a space for accepting the engaging portion (50), and extending downward under the anchoring member (17). The supporting member (13) is disposed at regular intervals at the position where a front surface (52) of the engaging portion (50) moves forward to make contact with the inner surface of the main body. The engaging portion (50) and the engaging rod portion (51) respectively have a projection (20) and engaging projection (21) that engage with each other. The projection (20) extends downward from the claw-like portion of the engaging portion (50) extending backwards. The engaging projection (21) extends from the top facing the space that accepts the engaging rod portion (51). Moreover, sectional forms and the extending degree of the respective projections (20, 21) can be optionally determined according to torque acting on the trigger (14), and the timing of the trigger operation.

The above-mentioned piercing apparatus is made primarily of resin and is made therefore disposable.

Figure 2:
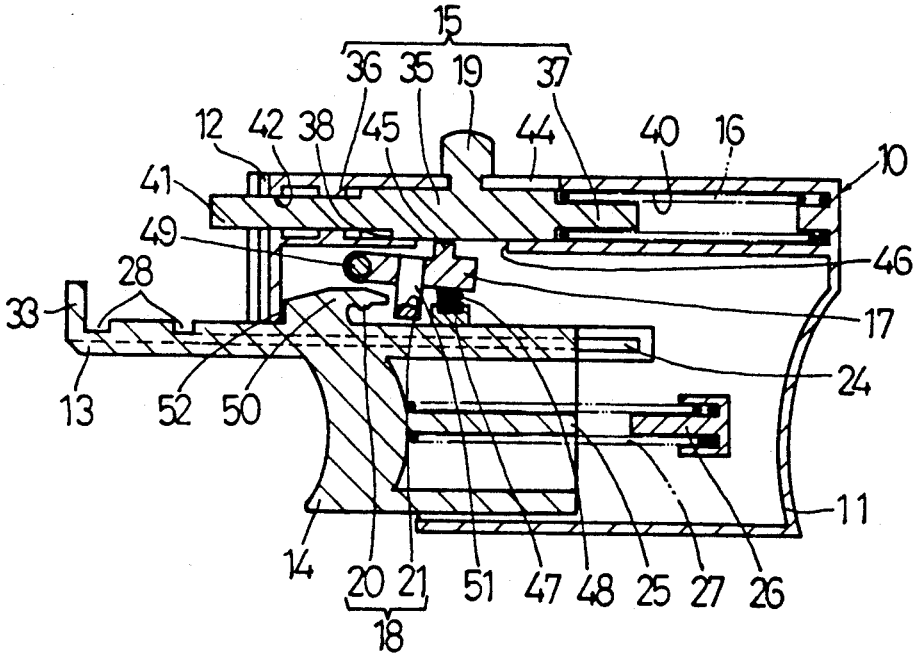
FIG. 2 is a cross sectional view illustrating the piercing apparatus.
Figure 3:
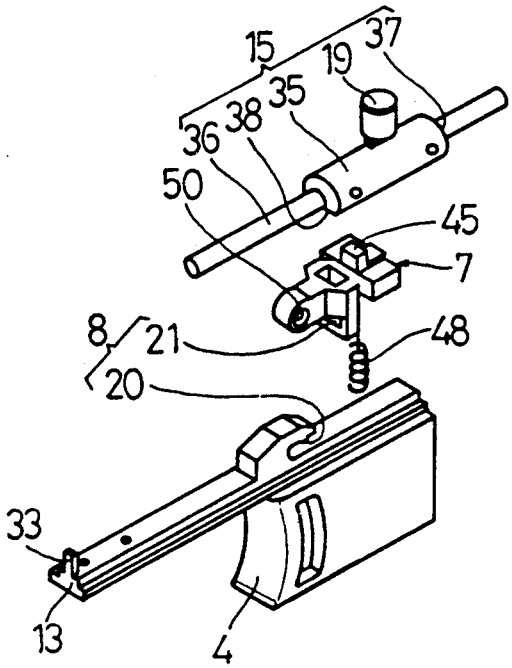
FIG. 3 is a perspective view illustrating the releasing means of the present invention.

The piercing apparatus, constructed as described above is operated in the following manner. The apparatus is set as shown in FIG. 2 before the operation. The trigger (14) is positioned forward, next to the spring (27), and the shooting-out shaft (15) is also positioned forward next to the shooting-out spring (16). After peeling off the seal of the cartridge (C), the front member (3) and the back member (4) are separated by moving one backward and the other forward. Th front member (3) is attached to the engaging portion (28) of the supporting rod (13), and the back member (4) is attached to the anchoring groove (12) of the main body, respectively. The operating knob (19) slides backwards in advance. At this time, the anchoring step portion (38) of the shooting-out shaft (15) engages the projection (45) of the anchoring member (17) so that pressure is stored in the shooting-out spring (16).

Figure 4:
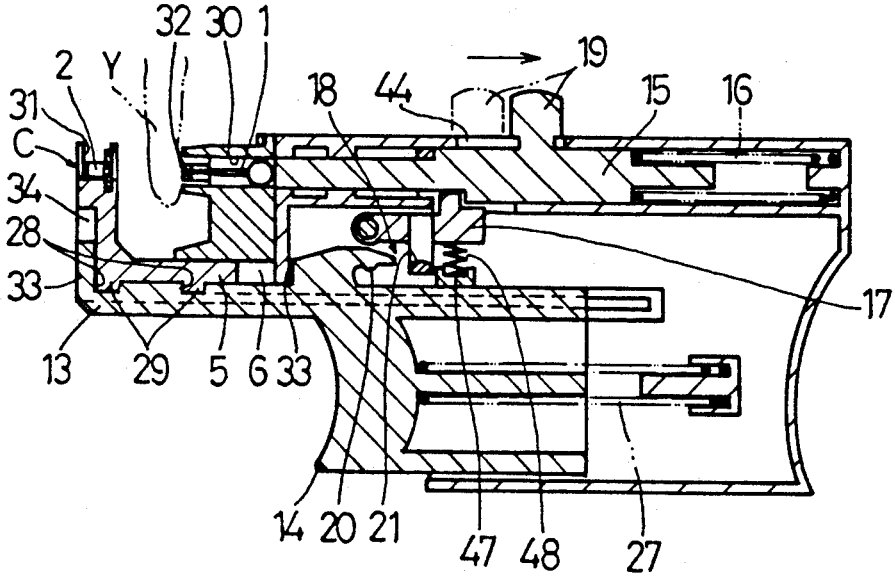
FIG. 4 is an explanatory view illustrating the operation of the piercing apparatus.

Next, the piercing apparatus is positioned so that the earlobe (Y) is disposed between the front member (3) and the back member (4) of the cartridge (C). When the trigger (14) is pressed, the front member (3) moves backward toward the back member (4). The torque generated by pressing the trigger (14) is very small since pressure is loaded in the spring (16) until the projection (20) on the side of the trigger (14) makes contact with the engaging projection (21) on the side of the anchoring member (17). The above operation results in the earlobe (Y) being pinched between the front member (3) and the back member (4). Therefore, it is possible to assure that the piercing apparatus is precisely positioned with respect to the desired position of the earlobe (Y) (FIG. 4). It goes without saying that the cartridge (C) is sanitary, and the earlobe is disinfected.

Figure 5:
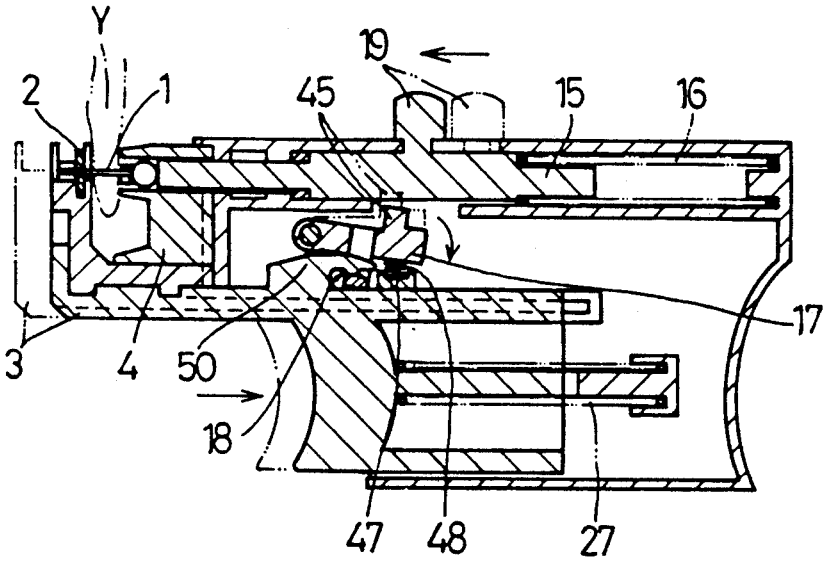
FIG. 5 is an explanatory view illustrating the operation of the piercing apparatus.

The trigger (14) is squeezed harder, the torque generated by squeezing the trigger (14) increases rapidly since the projection (20) of the releasing means (18) makes contact with the engaging projection (21). Furthermore, the anchoring member (17) is pulled down to remove the projection (45) of the anchoring member (17) from the anchoring step portion (38). Thus, the shooting-out shaft (15) quickly moves forward and shoots out the piercing needle (1). As a result, the piercing needle (1) is pierced through the earlobe (Y) instantly so that the pointed end of the piercing needle (1) fits into the fastener (2) (FIG. 5). After the piercing needle (1) has been shot out, the pointed end portion of the shooting-out shaft (15) enters the holding hole (30), and the head portion of the piercing needle (1) fractures the stop member (32).

Thereafter, the trigger (14) is repositioned to move the supporting rod (13) forward. Accordingly, the needle (1) with the head portion is push forward and removed from the back member (4), and the fastener (2) is removed from the groove (31). As a result, the operation of mounting the earring in the earlobe (Y) is completed.

The piercing apparatus of the present invention is constructed and operated as described above. Namely, it is possible to place the earlobe (Y) carefully between the front member (3) and the back member (4) of the cartridge (C), and assure the position by pressing the trigger (14) while grasping the grip (11). Under this condition, the trigger (14) can be operated with a small torque generated by pressing the trigger (14). And the trigger (14) is squeezed harder, the torque increases rapidly. Furthermore, the trigger (14) can be squeezed completely to release the anchorage of the shooting-out shaft (15) making the piercing needle (1) pierce through the earlobe (Y) instantly as a result of the elastic force of the spring (16) due to the stored pressure. Consequently, it is possible to clearly ascertain the proper timing to shoot the piercing needle (1) by means of the magnitude of the rapidly increasing torque. Therefore, the piercing needle (1) cannot be unintentionally shot, thereby significantly reducing the waste of needles. That is, an excellent effect can be obtained in that the desired piercing operation can be executed stably without and safety apparatus.

What is claimed is:

1. A piercing apparatus that uses a cartridge which couples a front member and a back member which can move close to and away from each other; this device has a piercing needle and a fastener connected to the needle, and the piercing needle is shot through an earlobe to mount a pierced earring with the fastener, the piercing apparatus further consists of:

a hollow main body with a grip for one hand at the lower part of the apparatus, and a mounting portion to mount a back member in the cartridge in the forward portion;

a trigger with a supporting member which extends forward to mount the front member in the cartridge, and is spring-loaded forward in order to dispose the front and back members of the cartridge at separate positions;

a shooting-out shaft which can be operated from the outside, and can move back and forth behind the mounting portion in the main body, and press the piercing needle in the cartridge out at the pointed end;

a spring where pressure is stored by an operation to move the shooting-out shaft backward;

an anchoring member spring-loaded in the same direction as the shooting-out shaft in order to anchor the shooting-out shaft at the position where pressure is stored; and a releasing means disposed in the forward or backward position with respect to the anchoring member, and provided to engage with the anchoring member to release the anchorage of the shooting-out shaft as the front member comes close to the back member by means of an operation of the trigger, said releasing means further comprising means for rapidly increasing torque acting against said operation of the trigger.

2. A piercing apparatus according to claim 1, wherein the shooting-out shaft has an operating grip mounted together with the shooting-out shaft and extending outwardly from the main body.

3. A piercing apparatus according to claim 1, wherein the releasing means is disposed on the top of the trigger, and the piercing apparatus further consists of a projection that can move back and forth by the operation of the trigger, an engaging projection disposed in a position allowing it to engage with the projection when the shooting-out shaft is anchored, and extending from the anchoring member so that it can make contact with and become attached to the projection via the operation of the trigger.

* * * * *